US006715403B2

(12) United States Patent
Hajek, Jr. et al.

(10) Patent No.: US 6,715,403 B2
(45) Date of Patent: Apr. 6, 2004

(54) INDEPENDENT AND REGENERATIVE MODE FLUID CONTROL SYSTEM

(75) Inventors: Thomas J. Hajek, Jr., Lockport, IL (US); Srikrishnan T. Tolappa, deceased, late of Aurora, IL (US), by Rangamani Srikrishnan, legal representative

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 0 days.

(21) Appl. No.: 10/244,077

(22) Filed: Sep. 16, 2002

(65) Prior Publication Data

US 2003/0106423 A1 Jun. 12, 2003

Related U.S. Application Data

(60) Provisional application No. 60/328,450, filed on Oct. 12, 2001.

(51) Int. Cl.[7] ..... F15B 11/00

(52) U.S. Cl. ..... 91/531; 91/525

(58) Field of Search ..... 91/6, 525, 531, 91/436; 60/414

(56) References Cited

U.S. PATENT DOCUMENTS

| | | | |
|---|---|---|---|
| 3,187,637 | A | 6/1965 | Edmund |
| 3,960,059 | A | 6/1976 | Schexnayder |
| 4,033,129 | A | 7/1977 | Hetzler et al. |
| 4,149,565 | A | 4/1979 | Jennings et al. |
| 4,263,746 | A | 4/1981 | Eller et al. |
| 4,473,090 | A | 9/1984 | Uehara et al. |
| 4,610,193 | A | 9/1986 | Barker et al. |
| 4,611,527 | A | 9/1986 | Breeden |
| 4,690,035 | A | 9/1987 | Bouteille et al. |
| 4,702,148 | A | 10/1987 | Kussel et al. |
| 4,809,586 | A | 3/1989 | Gage et al. |
| 4,833,798 | A | 5/1989 | Ehrich |
| 4,967,557 | A | 11/1990 | Izumi et al. |
| 5,046,309 | A | 9/1991 | Yoshino |
| 5,065,844 | A | 11/1991 | Hon |
| 5,220,862 | A | 6/1993 | Schexnayder |
| 5,370,038 | A | 12/1994 | Poppe et al. |
| 5,473,970 | A | 12/1995 | Hayashi et al. |
| 5,862,831 | A | 1/1999 | Chung et al. |
| 5,868,059 | A | 2/1999 | Smith |
| 5,927,520 | A | 7/1999 | Barthalow et al. |
| 6,155,282 | A | 12/2000 | Zachary et al. |
| 6,161,467 | A | 12/2000 | A'Hearn et al. |
| 6,164,327 | A | 12/2000 | Yoshida |
| 6,186,044 | B1 | 2/2001 | Hajek, Jr. et al. |

*Primary Examiner*—Edward K. Look
*Assistant Examiner*—Michael Leslie
(74) *Attorney, Agent, or Firm*—Finnegan, Henderson, Farabow, Garrett & Dunner

(57) ABSTRACT

A fluid control system is disclosed that includes a reservoir, a pump in fluid communication with the reservoir, a first double-acting actuator having a first head end chamber and a first rod end chamber, a second double-acting actuator having a second head end chamber and a second rod end chamber. The first and second double-acting actuators are selectively fluidly connected via a conduit. A first independent metering valve is configured to selectively provide fluid flow to the first and second double-acting actuators, and a second independent metering valve is configured to selectively provide fluid flow to the first and second double-acting actuators. The fluid control system also includes a proportional valve attached to the conduit between the first double-acting actuator and the second double-acting actuator. The proportional valve is capable of operating the fluid control system in either an independent function mode or a regenerative function mode.

15 Claims, 2 Drawing Sheets

INDEPENDENT AND REGENERATIVE MODE FLUID CONTROL SYSTEM

This application claims the benefit of U.S. Provisional Application Ser. No. 60/328,450 entitled "Independent and Regenerative Mode Fluid Control System," filed Oct. 12, 2001.

TECHNICAL FIELD

This invention relates to a fluid control system for operating actuators. More particularly, the invention is directed to a fluid control system for operating multiple actuators in independent and regenerative function modes.

BACKGROUND

Some fluid control systems operate a double-acting actuator with a regeneration capability. The fluid control systems with this regeneration capability direct some of the fluid exhausted from a contracting chamber of a double-acting actuator to an expanding chamber of the actuator.

In the past, a regeneration valve is typically disposed between a main directional control valve and an actuator to provide a quick drop capability to the actuator driven in one direction by gravity loads. In such a configuration, however, an operator has little or no control over the amount of regenerated fluid recirculated from the contracting chamber to the expanding chamber.

A fluid control system with a relatively simple regeneration capability has been provided in association with a pump, a tank, and a double-acting actuator having a pair of actuating chambers. For example, U.S. Pat. No. 6,161,467 discloses a fluid control system having a regeneration capability. The system includes a pump, a tank, two double-acting actuators having actuating chambers, and a control valve. The control valve moves from a first position to a second position in a regeneration mode. This fluid control system, however, does not allow operation of the multiple actuators both regeneratively and independently. It is desirable to provide a fluid control system that provides accurate control of the actuators and has a compact size.

Accordingly, the present invention is directed to overcoming one or more of the problems as set forth above.

SUMMARY OF THE INVENTION

In one aspect of the invention, a fluid control system includes a reservoir, a pump in fluid communication with the reservoir, a first double-acting actuator having a first head end chamber and a first rod end chamber, a second double-acting actuator having a second head end chamber and a second rod end chamber. The first and second double-acting actuators are selectively fluidly connected via a conduit. A first independent metering valve is configured to selectively provide fluid flow to the first and second double-acting actuators, and a second independent metering valve is configured to selectively provide fluid flow to the first and second double-acting actuators. The fluid control system also includes a proportional valve attached to the conduit between the first double-acting actuator and the second double-acting actuator. The proportional valve is capable of operating the fluid control system in either an independent function mode or a regenerative function mode.

In another aspect of the invention, a method is provided to control fluid flow to and from first and second double-acting actuators in an independent function mode and a regenerative function mode. A first independent metering valve is provided having a first check valve in fluid communication with the first and second double-acting actuators. A second independent metering valve is also provided having a second check valve in fluid communication with the first and second double-acting actuators. A proportional valve is further provided in fluid communication with the first and second double-acting actuators. The proportional valve is operated to allow the first and second actuators to selectively operate in independent and regenerative function modes.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention.

DETAILED DESCRIPTION

Reference will now be made in detail to the present preferred embodiments of the invention, examples of which are illustrated in the accompanying drawings. Wherever possible, the same reference numbers will be used throughout the drawings to refer to the same or like parts.

Figure 1:
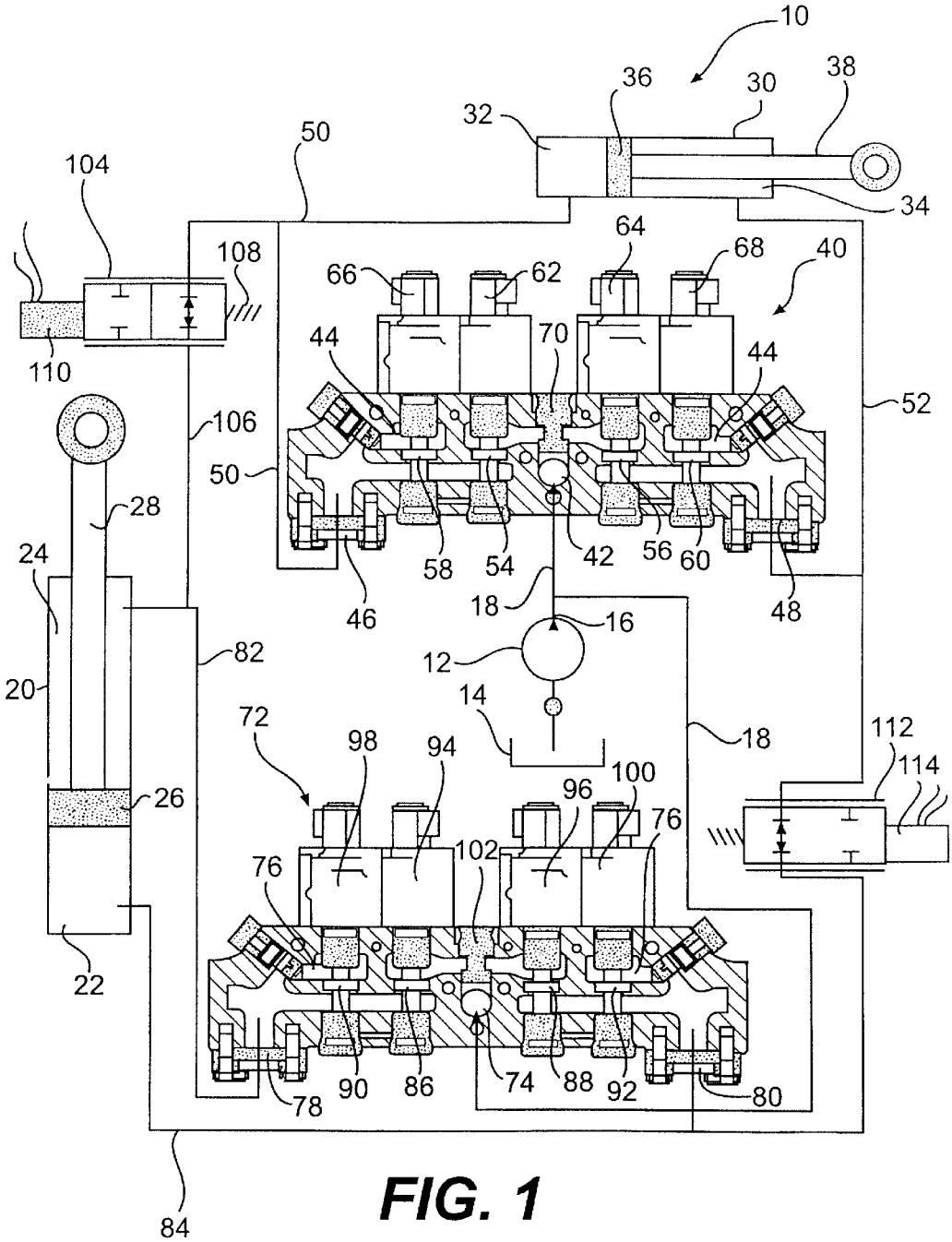
FIG. 1 is a schematic and diagrammatic representation of an fluid control system according to one embodiment of the present invention.

FIG. 1 illustrates one embodiment of the fluid control system of the present invention having regenerative and independent function modes. The fluid control system 10 has a pump 12 and a reservoir 14 in fluid communication with the pump 12. The pump 12 is typically driven by a motor (not shown in the figure), such as an engine, and receives fluid from the reservoir 14. The pump 12 has a pump outlet port 16 connected to a supply conduit 18.

In one contemplated embodiment, the fluid control system 10 includes a first double-acting actuator 20. The first double-acting actuator 20 has a pair of actuating chambers, namely a head end actuating chamber 22 and a rod end actuating chamber 24. The head end chamber 22 and the rod end chamber 24 are separated by a piston 26 having a piston rod 28. The double-acting actuator 20 may be a hydraulic cylinder or any other suitable implement device used for raising, lowering or tilting parts of a machine, such as an excavator or a track loader.

The fluid control system 10 has a second double-acting actuator 30. Similar to the first actuator 20, the second double-acting actuator 30 has a second head end chamber 32 and a second rod end chamber 34 separated by a piston 36. A piston rod 38 is connected to the piston 36. The second double-acting actuator 30 may also be a hydraulic cylinder or any other suitable implement device.

The fluid control system 10 includes a first independent metering valve (IMV) 40. As shown in FIG. 1, the first IMV 40 has an inlet port 42 and two outlet ports 44. The inlet port 42 is connected to the pump 12 via the supply conduit 18 and receives the pressurized fluid from the pump. The outlet ports 44 may be connected to a reservoir (the connection is not shown in the figure) to discharge fluid out of the first IMV 40. In one embodiment, this reservoir may be the reservoir 14 connected to the pump 12.

The first IMV 40 also has first and second control ports 46, 48, respectively. In FIG. 1, the first control port 46 is connected to the head end chamber 32 of the second double-acting actuator 30 by a conduit 50, and the second control port 48 is connected to the rod end chamber 34 of the second double-acting actuator 30 by a conduit 52.

The first IMV 40 has four independently operable valves. A first independently operable valve 54 is disposed between the inlet port 42 and the first control port 46, and a second independently operable valve 56 is disposed between the inlet port 42 and the second control port 48. A third independently operable valve 58 is disposed between the outlet port 44 and the first control port 46, and a fourth independently operable valve 60 is disposed between the outlet port 44 and the second control port 48. In one contemplated embodiment, these independently operable valves are proportional valves that can vary fluid flow through the valves based on load requirements. Each of the valves may be equipped with a spring (not shown) to keep the valves in a closed position when the valves are not activated.

The first IMV 40 has solenoid 62 coupled to the first independently operable valve 54 to operate the valve when the solenoid is energized. A second solenoid 64, a third solenoid 66 and a fourth solenoid 68 are coupled to the second, third and fourth independently operable valves 56, 58, 60, respectively to operate the valves in a similar fashion. These solenoids are energized by a control unit (not shown) to selectively open and close the independently operable valves.

The first IMV 40 includes a check valve 70 between the inlet port 42 and the first and second independently operable valves 54, 56. The check valve 70 may be located near the inlet port 42 and is biased toward a closed position by a spring (not shown in the figure). When the pump 14 supplies the check valve with sufficient fluid pressure via the supply conduit 18 and the inlet port 42, the check valve 70 is pushed open by the fluid pressure and the fluid from the pump 12 flows through the check valve 70 to the first and second valves 54, 56 of the first IMV 40.

The fluid control system 10 also includes a second independent metering valve (IMV) 72. In one embodiment, the second IMV 72 is located parallel to the first IMV 40 so that the overall size of the fluid control system 10 can be minimized. The structure of the second IMV 72 may be similar to the first IMV 40. As shown in FIG. 1, the second IMV 40 has an inlet port 74 and two outlet ports 76. The inlet port 74 is connected to the pump 12 via the supply conduit 18 and receives the pressurized fluid from the pump. FIG. 1 illustrates the supply conduit 18 branched into two conduits to supply the pressurized fluid to the inlet port 74 of the second IMV 72 as well as the inlet port 42 of the first IMV 40. The outlet ports 76 may be connected to a reservoir (the connection is not shown in the figure) to discharge the fluid out of the second IMV 72. This reservoir may be the reservoir 14 connected to the pump 12.

The second IMV 72 also has first and second control ports 78,80, respectively. The first control port 78 is connected to the rod end chamber 24 of the first double-acting actuator 20 by a conduit 82, and the second control port 80 is connected to the head end chamber 22 of the first double-acting actuator 20 by a conduit 84.

As illustrated in FIG. 1, the second IMV 72 has four independently operable valves, namely first, second, third and fourth independently operable valves 86, 88, 90, 92, respectively. The first independently operable valve 86 is disposed between the inlet port 74 and the first control port 78, and the second independently operable valve 88 is disposed between the inlet port 74 and the second control port 80. The third independently operable valve 90 is disposed between the outlet port 76 and the first control port 78. The fourth independently operable valve 92 is disposed between the outlet port 76 and the second control port 80. In one contemplated embodiment, these independently operable valves are proportional valves that can vary fluid flow through the valves based on load requirements. Each of the valves may be equipped with a spring (not shown) to keep the valves in a closed position at rest.

Similar to the first IMV 40, the second IMV 72 also has a first solenoid 94 coupled to the first independently operable valve 86 to operate the valve when the solenoid is energized. A second solenoid 96, a third solenoid 98 and a fourth solenoid 100 are coupled to the second, third and fourth independently operable valves 88, 90, 92, respectively, to operate the valves. These solenoids are energized by a control unit (not shown) to selectively open and close the independently operable valves.

The second IMV 72 includes a check valve 102 between the inlet port 74 and the first and second independently operable valves 86,88. The check valve 102 may be located near the inlet port 74 and is biased toward a closed position by a spring (not shown in FIG. 1). When the pump 14 supplies the check valve 102 with sufficient fluid pressure via the supply conduit 18 and the inlet port 74, the check valve 102 is pushed open by the fluid pressure and the fluid flows through the check valve 102 to the first and second valves 86,88.

The fluid control system 10 includes a proportional valve 104 between the first double-acting actuator 20 and the second double-acting actuator 30. As shown in FIG. 1, the proportional valve 104 may be attached to a conduit 106 that is connected to the first double-acting actuator 20 via the conduit 82 and the second double-acting actuator 30 via the conduit 50. In another embodiment, the conduit 106 may be directly connected to the rod end chamber 24 of the first double-acting actuator 20 and the head end chamber 32 of the second actuator 30.

The proportional valve 104 can be either normally opened or closed and can be actuated to close or open by energizing a solenoid 110 associated with the proportional valve 104. In FIG. 1, a spring 108 is provided to keep the proportional valve 104 in an open position when not activated. Thus, the proportional valve 104 is a normally open proportional valve.

In another contemplated embodiment, the fluid control system 10 may include a second proportional valve 112. Similar to the proportional valve 104, the second proportional valve 112 has a solenoid 114 that can be actuated to either open or close the second proportional valve 112. The second proportional valve 106 can be either normally opened or closed. As shown in FIG. 1, the second proportional valve 112 is connected to the head end chamber 22 of the first actuator 20 via the conduit 84 and to the rod end chamber 34 of the second actuator 30 via the conduit 52. In another embodiment, the second proportional valve 112 may be directly connected to the head end chamber 22 of the first actuator 20 and the rod end chamber 34 of the second actuator 30.

Figure 2:
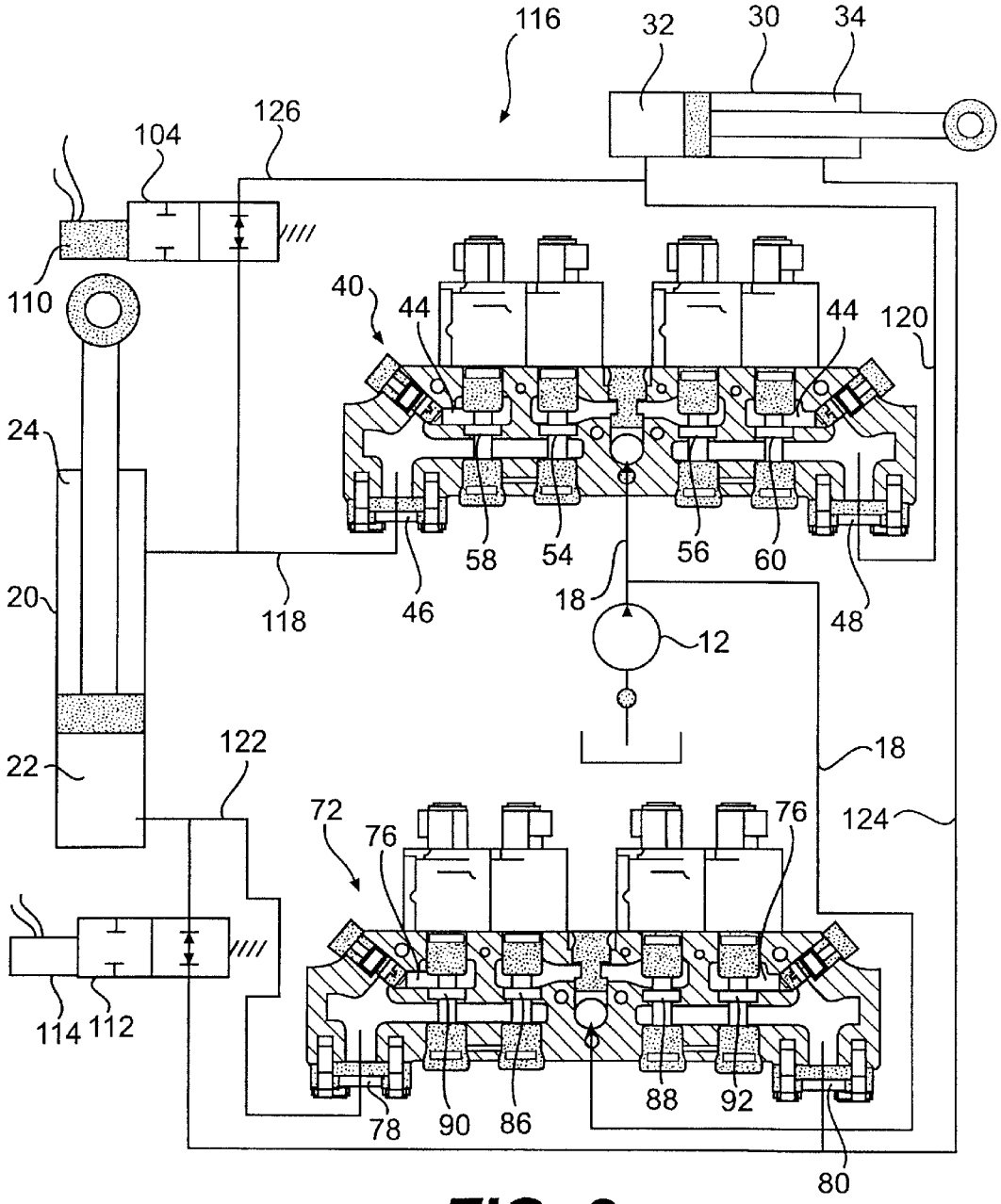
FIG. 2 is a schematic and diagrammatic representation of an fluid control system according to another embodiment of the present invention.

FIG. 2 illustrates another embodiment of the fluid control system of this invention. Similar to the fluid control system 10 in FIG. 1, a fluid control system 116 in FIG. 2 includes a pump, first and second actuators 20, 30, and first and second IMVs 40, 72, respectively. The same reference numerals as in FIG. 1 are designated to these same elements in FIG. 2.

The fluid control system 116 has a conduit 118 that is connected to the first control port 46 of the first IMV 40 and the rod end chamber 24 of the first double-acting actuator 20. A conduit 120 is connected to the second control port 48 and the head end chamber 32 of the second double-acting actuator 30. The fluid system 116 also has a conduit 122 connected to the first control port 78 of the second IMV 72 and the head end chamber 22 of the first actuator 20. A conduit 124 is connected to the second control port 80 of the second IMV 72 and the rod end chamber 34 of the second actuator 30.

The fluid control system 116 also includes proportional valve 104 disposed between the first double-acting actuator 20 and the second double-acting actuator 30. As shown in FIG. 2, the proportional valve 104 may be attached to a conduit 126 that is connected to the first double-acting actuator 20 via the conduit 118 and the second double-acting actuator 30 via the conduit 120. In another embodiment, the conduit 126 may be directly connected to the rod end chamber 24 of the first double-acting actuator 20 and the head end chamber 32 of the second actuator 30. The proportional valve 104 can be either normally opened or closed and can be actuated to close or open by energizing a solenoid 110 provided to the proportional valve 104. The proportional valve 104 in FIG. 2 is a normally open proportional valve.

In another embodiment, the fluid control system 116 may include the second proportional valve 112. Similar to the proportional valve 104, the second proportional valve 112 has a solenoid 114 that can be actuated to either open or close the second proportional valve 112. As shown in FIG. 2, the second proportional valve 112 is connected to the head end chamber 22 of the first actuator 20 via the conduit 122 and to the rod end chamber 34 of the second actuator 30 via the conduit 124. In another embodiment, the second proportional valve 112 may be directly connected to the head end chamber 22 of the first actuator 20 and the rod end chamber 34 of the second actuator 30.

Industrial Applicability

The operation of the fluid control system 10 illustrated in FIG. 1 is described hereafter. When the pump 12 is operated, fluid flows from the pump 12 to the inlet port 42 of the first IMV 40 and the inlet port 74 of the second IMV 72 via the split conduit 18. The fluid pressure is applied to the check valve 70 of the first IMV 40 and the check valve 102 of the second IMV 72. The check valves 70, 102 are initially in the closed position. When the fluid pressure from the pump 12 becomes sufficiently high, the check valves 70, 102 open and the pressurized fluid from the pump 12 flows through the check valves 70, 102. The fluid from the pump 12 then flows to the first and second independently operable valves 54, 56 of the first IMV 40. Similarly, the fluid from the pump 12 flows to the first and second independently operable valves 86, 88 of the second IMV 72.

When the fluid control system 10 is in the independent function mode, the proportional valves 104,112 are in the closed position. To pressurize the head end chamber 22 of the first double-acting actuator 20, the second valve 88 of the second IMV 72 is opened and the fourth valve 92 is closed. The pressurized fluid from the pump 12 flows through the second IMV 72 to the head end chamber 22 of the first double-acting actuator 20 via the second control port 80 and the conduit 84. Consequently, the piston 26 and the piston rod 28 move in the upward direction in the orientation of FIG. 1. At the same time, the fluid in the rod end chamber 24 of the first actuator 20 flows to the second IMV 72 through the conduit 82 and the first control port 78 of the second IMV 72. Because the proportional valve 104 is closed in the independent function mode, the fluid from the rod end chamber 24 does not flow to the second actuator 30 through the conduit 106 and the conduit 50. The third valve 90 of the second IMV 72 is opened and the fluid from the actuator 20 can exit to, inter alia, a reservoir through the third valve 90. In this case, the first valve 86 of the second IMV 72 should be closed so that the pressurized fluid from the pump 12 does not flow through the valve.

The actuation of the first actuator 20 may be reversed by opening the first valve 86 and closing the third valve 90 of the second IMV 72, and opening the fourth valve 92 and closing the second valve 88 of the second IMV 72. The pressurized fluid from the pump 12 flows through the first valve 86 to the rod end chamber 24 of the first actuator 20 via the first control port 78 and the conduit 82. Consequently, the piston 26 and the piston rod 28 move in the downward direction in the orientation of FIG. 1. The fluid in the head end chamber 22 flows to a reservoir through the conduit 84, the second control port 80, and the fourth valve 92 of the second IMV 72.

Similarly, the first valve 54 of the first IMV 40 can be opened to allow fluid flow through the first valve 54 to the head end chamber 32 of the second actuator 30 to move the piston 36 and the piston rod 38. Simultaneously, the fluid from the rod end chamber 34 of the second actuator 30 flows via the conduit 52 to the second control port 48 of the first IMV 40. The fourth valve 60 should be open to discharge the fluid from the rod end chamber 34 to a reservoir. During this operation, the second valve 56 and the third valve 58 of the first IMV 40 should be closed. To reverse the direction of the second actuator 30, the second valve 56 and the third valve 58 of the first IMV 40 should be opened, and the first valve 54 and the fourth valve 60 of the first IMV 40 should be closed.

In the above described manner, the first and second double-acting actuators 20,30 are operated and controlled independently. Next, the operation of the fluid control system 10 in the regenerative function mode is described.

In the regenerative mode, either the proportional valve 104 or the second proportional valve 112 is opened. As described above, when the second valve 88 of the second IMV is open, the pressurized fluid flows to the head end chamber 22 of the first actuator 20. The fluid in the rod end chamber 24 then flows out of the chamber. When the proportional valve 104 is opened and the first and third valves 86, 90 of the second IMV 72 are closed, the fluid from the rod end chamber 24 flows through the conduit 106, the proportional valve 104, and the conduit 50 to the head end chamber 32 of the second actuator 30. The fluid in the rod end chamber 34 then flows out to the first IMV 40 via conduit 52 and the second control port 48. In this regenerative function mode, the second proportional valve 112, and the first, second and third valves 54, 56, 58 of the first IMV 40 should be all closed. The fourth valve 60 should be opened so that fluid from the rod end chamber 24 of the first actuator 20 flows into the head end chamber 32 of the second actuator 30. The fluid in the rod end chamber 34 of the second actuator 30 flows through the fourth valve 60 of the first IMV 40 to the outlet port 44. In this regenerative function mode, the first actuator 20 is operated under higher fluid pressure than the second actuator 30.

The direction of the actuators 20,30 can be reversed by closing the first, third, and fourth valves 54, 58, 60 of the first IMV 40 and the first, second and third valves 86, 88, 90 of the second IMV 72, and opening the second valve 56 of the first IMV 40 and the fourth valve 92 of the second IMV 72. In this case, the second actuator 30 is operated under higher fluid pressure than the first actuator 20.

Alternatively, the proportional valve 104 may be closed and the second proportional valve 112 may be opened. When the first valve 54 of the first IMV 40 and the third valve 90 of the second IMV 72 are opened, and the second, third and fourth valves 56, 58, 60 of the first IMV 40 and the first, second and fourth valves 86, 88, 92 of the second IMV 72 are closed, the fluid from the pump 12 flows through the first valve 54 of the first IMV 40 to the head end chamber 32 of the second actuator 30 via the conduit 50. The fluid will not flow through the proportional valve 104 since it is closed. The fluid in the rod end chamber 34 flows through the conduit 52, the second proportional valve 112 and the conduit 84 to the head end chamber 22 of the first actuator 20. The fluid in the rod end chamber 24 flows to the outlet port 76 of the second IMV 72 via the conduit 82, the first control port 78, and the third valve 90. In this regenerative function mode, the second actuator 30 is operated under higher fluid pressure than the first actuator 20.

To change the actuator direction of the first and second actuators 20, 30, the first valve 86 of the second IMV 72 and the third valve 58 of the first IMV 40 are opened, and the second, third and fourth valves 88, 90, 92 of the second IMV 72 and the first, second and fourth valves 54, 56, 60 of the first IMV 40 are closed. In this mode, the fluid from the pump 12 flows through the first valve 86 of the second IMV 72 to the rod end chamber 24 of the first actuator 20 via the conduit 82. The fluid will not flow through the proportional valve 104 since it is closed. The fluid in the head end chamber 22 flows through the conduit 84, the second proportional valve 112, and the conduit 52 to the rod end chamber 34 of the second actuator 30. The fluid in the head end chamber 32 flows to the outlet port 44 of the first IMV 40 via the conduit 50, the first control port 46, and the third valve 58. In this case, the first actuator 20 is operated under higher fluid pressure than the second actuator 30.

The operation of the fluid control system 116 shown in FIG. 2 is described hereafter.

When the fluid control system 116 is in the independent function mode, the proportional valves 104, 112 are in the closed position. To pressurize the head end chamber 22 of the first double-acting actuator 20, the first valve 86 of the second IMV 72 is opened and the third valve 90 is closed. The pressurized fluid from the pump 12 flows through the second IMV 72 to the head end chamber 22 of the first double-acting actuator 20 via the first control port 78 and the conduit 122. Consequently, the piston 26 and the piston rod 28 move in the upward direction according to the orientation of FIG. 2. At the same time, the fluid in the rod end chamber 24 of the first actuator 20 flows to the first IMV 40 through the conduit 118 and the first control port 46 of the first IMV 40. Because the proportional valve 104 is closed in the independent function mode, the fluid from the rod end chamber 24 does not flow to the second actuator 30 through the conduit 126. The third valve 58 of the first IMV 40 is opened, and the fluid from the actuator 20 can exit to a reservoir through the third valve 58. In this case, the first valve 54 of the first IMV 40 should be closed so that the pressurized fluid from the pump 12 does not flow through that valve.

The actuation of the first actuator 20 may be reversed by opening the first valve 54 and closing the third valve 58 of the first IMV 40, and opening the third valve 90 and closing the first valve 86 of the second IMV 72. The pressurized fluid from the pump 12 flows through the first valve 54 of the first IMV 40 to the rod end chamber 24 of the first actuator 20 via the first control port 46 and the conduit 118. Consequently, the piston 26 and the piston rod 28 move in the downward direction according to the orientation of FIG. 2. The fluid in the head end chamber 22 flows to the reservoir 14 through the conduit 122, the first control port 78, and the third valve 90 of the second IMV 72.

Similarly, the second valve 56 of the first IMV 40 can be opened to allow fluid flow through the second valve 56 to the head end chamber 32 of the second actuator 30 to move the piston 36 and the piston rod 38. Simultaneously, the fluid from the rod end chamber 34 of the second actuator 30 flows via the conduit 124 to the second control port 80 of the second IMV 72. The fourth valve 92 of the second IMV 72 should be open to discharge the fluid from the rod end chamber 34 to a reservoir. During this operation, the fourth valve 60 of the first IMV 40 and the second valve 88 of the second IMV 72 should be closed. To reverse the direction of the second actuator 30, the second valve 56 of the second IMV 72 and the fourth valve 60 of the first IMV 40 should be opened, and the fourth valve 92 of the second IMV 72 and the second valve 56 of the first IMV 40 should be closed.

In the above described manner, the fluid control system 116 operates in the independent function mode. Next, the operation of the fluid control system 116 in the regenerative function mode is described.

In the regenerative mode, either the proportional valve 104 or the second proportional valve 112 is opened. As described above, when the first valve 86 of the second IMV 72 is open, the pressurized fluid flows to the head end chamber 22 of the first actuator 20. The fluid in the rod end chamber 24 then flows out of the chamber. When the proportional valve 104 is opened and the first and third valves 54, 58 of the first IMV 40 are closed, the fluid from the rod end chamber 24 flows through the conduit 118, the proportional valve 104, and the conduit 126 to the head end chamber 32 of the second actuator 30. The fluid in the rod end chamber 34 flows out to the second IMV 72 via conduit 124 and the second control port 80. In this regenerative function mode, the second proportional valve 112, the first, second, third, and fourth valves 54, 56, 58, 60 of the first IMV 40, and the second and third valves 88, 90 of the second IMV 72 should be all closed. The first and fourth valves 86, 92 of the second IMV 72 should be opened so that fluid from the rod end chamber 24 of the first actuator 20 flows into the head end chamber 32 of the second actuator 30. The fluid in the rod end chamber 34 of the second actuator 30 flows through the fourth valve 92 of the second IMV 72 to the outlet port 44. In this regenerative function mode, the first actuator 20 is operated under higher fluid pressure than the second actuator 30.

The direction of the actuators 20, 30 can be reversed by closing the first, second, third and fourth valves 54, 56, 58, 60 of the first IMV 40 and the first and fourth valves 86, 92 of the second IMV 72, and opening the second and third valves 88, 90 of the second IMV 72. In this case, the second actuator 30 is operated under higher fluid pressure than the first actuator 20.

Alternatively, the proportional valve 104 may be closed and the second proportional valve 112 may be opened. When the second and third valves 56, 58 of the first IMV 40 are opened, and the first and fourth valves 54, 60 of the first IMV 40, and the first, second, third and fourth valves 86, 88, 90, 92 of the second IMV 72 are all closed, the fluid from the pump 12 flows through the second valve 56 of the first IMV 40 to the head end chamber 32 of the second actuator 30 via the conduit 120. The fluid does not flow through the proportional valve 104 since it is closed. The fluid in the rod end chamber 34 flows through the conduit 124, the second proportional valve 112, and the conduit 122 to the head end chamber 22 of the first actuator 20. The fluid in the rod end chamber 24 flows to the outlet port 44 of the first IMV 40 via the conduit 118, the first control port 46, and the third valve 58. In this regenerative function mode, the second actuator 30 is operated under higher fluid pressure than the first actuator 20.

To change the actuator direction of the first and second actuators 20, 30, the first and fourth valves 54, 60 of the first IMV 40 are opened, and the first, second, third and fourth valves 86, 88, 90, 92 of the second IMV 72 and the second and third valves 56, 58 of the first IMV 40 are closed. In this mode, the fluid from the pump 12 flows through the first valve 54 of the first IMV 40 to the rod end chamber 24 of the first actuator 20 via the conduit 118. The fluid does not flow through the proportional valve 104 since it is closed. The fluid in the head end chamber 22 flows through the conduit 122, the second proportional valve 112, and the conduit 124 to the rod end chamber 34 of the second actuator 30. The fluid in the head end chamber 32 flows to the outlet port 44 of the first IMV 40 via the conduit 120, the second control port 48 and the fourth valve 60. In this case, the first actuator 20 is operated under higher fluid pressure than the second actuator 30.

Thus, the present invention provides a fluid control system to accurately control operation of multiple double-acting actuators in independent and regenerative modes. Moreover, the fluid control system is advantageous in that it can efficiently switch between the independent and regenerative function modes.

It will be apparent to those skilled in the art that various modifications and variations can be made in the electro-hydraulic pump control system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fluid control system, comprising:

a reservoir;

a pump in fluid communication with the reservoir;

a first double-acting actuator having a first head end chamber and a first rod end chamber;

a second double-acting actuator having a second head end chamber and a second rod end chamber, the first and second double-acting actuators being selectively fluidly connected via a conduit;

a first independent metering valve being configured to selectively provide fluid flow to the first and second double-acting actuators;

a second independent metering valve being configured to selectively provide fluid flow to the first and second double-acting actuators; and a proportional valve attached to the conduit between the first double-acting actuator and the second double-acting actuator, the proportional valve being capable of operating the fluid control system in either an independent function mode or a regenerative function mode.

2. The fluid control system of claim 1, wherein the proportional valve is closed for the independent function mode and opened for the regenerative function mode.

3. The fluid control system of claim 2, wherein the first independent metering valve includes a first control port and a second control port connected to the second double-acting actuator, and the second independent metering valve includes a first control port and a second control port connected to the first double-acting actuator, wherein the first and second control ports of the first independent metering valve are connected to the head end chamber and the rod end chamber of the second double-acting actuator, respectively, and the first and second control ports of the second independent metering valve are connected to the rod end chamber and the head end chamber of the first double-acting actuator, respectively.

4. The fluid control system of claim 3, wherein the proportional valve is attached to the conduit between the rod end chamber of the first double-acting actuator and the head end chamber of the second double-acting actuator.

5. The fluid control system of claim 4, wherein, in the regenerative function mode, fluid in the rod end chamber of the first double-acting actuator flows toward the head end chamber of the second double-acting actuator or fluid in the head end chamber of the second double-acting actuator flows toward the rod end chamber of the first double-acting actuator.

6. The fluid control system of claim 1, further including a second conduit between the first double-acting actuator and the second double-acting actuator and a second proportional valve attached to the second conduit.

7. The fluid control system of claim 6, wherein the second proportional valve is attached to the second conduit between the rod end chamber of the second double-acting actuator and the head end chamber of the first double-acting actuator.

8. The fluid control system of claim 2, wherein the first independent metering valve includes a first control port connected to the first double-acting actuator and a second control port connected to the second double-acting actuator, and the second independent metering valve includes a first control port connected to the first double-acting actuator and a second control port connected to the second double-acting actuator, wherein the first and second control ports of the first independent metering valve are connected to the rod end chamber of the first double-acting actuator and the head end chamber of the second double-acting actuator, respectively, and the first and second control ports of the second independent metering valve are connected to the head end chamber of the first double-acting actuator and the rod end chamber of the second double-acting actuator, respectively.

9. The fluid control system of claim 8, wherein the proportional valve is attached to the conduit between the rod end chamber of the first double-acting actuator and the head end chamber of the second double-acting actuator.

10. The fluid control system of claim 9, wherein, in the regenerative function mode, fluid in the rod end chamber of the first double-acting actuator flows toward the head end chamber of the second double-acting actuator or fluid in the head end chamber of the second double-acting actuator flows toward the rod end chamber of the first double-acting actuator.

11. The fluid control system of claim 10, further including a second conduit between the first double-acting actuator and the second double-acting actuator and a second proportional valve attached to the second conduit.

12. The fluid control system of claim 11, wherein the second proportional valve is attached to the second conduit between the rod end chamber of the second double-acting actuator and the head end chamber of the first double-acting actuator.

13. A method of controlling fluid flow to and from first and second double-acting actuators in an independent function mode and a regenerative function mode, comprising:

providing a first independent metering valve having a first check valve in fluid communication with the first and second double-acting actuators;

providing a second independent metering valve having a second check valve in fluid communication with the first and second double-acting actuators;

providing a proportional valve in fluid communication with the first and second double-acting actuators;

operating the proportional valve to allow the first and second actuators to selectively operate in independent and regenerative function modes.

14. The method of claim 13, wherein the proportional valve is closed for the independent function mode and opened for the regenerative function mode.

15. The method of claim 13, wherein, in the regenerative function mode, fluid in a rod end chamber of the first double-acting actuator flows toward a head end chamber of the second double-acting actuator or fluid in the head end chamber of the second double-acting actuator flows toward the rod end chamber of the first double-acting actuator.

* * * * *